US008910806B2

(12) United States Patent
Stinis

(10) Patent No.: US 8,910,806 B2
(45) Date of Patent: Dec. 16, 2014

(54) METHOD FOR CONTROLLING A HOISTING OR PAYING OUT MOVEMENT AND HOISTING FRAME HAVING TILTABLE CABLE SHREAVE FOR USE THEREIN

(75) Inventor: Cornelis Stinis, AB Krimpen Aan de Lek (NL)

(73) Assignee: STINIS Beheer B.V., Krimpen an de Lek (NL)

( * ) Notice: Subject to any disclaimer, the term of this patent is extended or adjusted under 35 U.S.C. 154(b) by 1083 days.

(21) Appl. No.: 12/681,088

(22) PCT Filed: Oct. 1, 2008

(86) PCT No.: PCT/NL2008/000212

§ 371 (c)(1),
(2), (4) Date: Aug. 5, 2010

(87) PCT Pub. No.: WO2009/045098

PCT Pub. Date: Apr. 9, 2009

(65) Prior Publication Data

US 2011/0120968 A1 May 26, 2011

(30) Foreign Application Priority Data

Oct. 1, 2007 (NL) ..... 1034449

(51) Int. Cl.
*B66C 13/18* (2006.01)
*B66C 1/10* (2006.01)
*B66C 15/06* (2006.01)

(52) U.S. Cl.
CPC ..... *B66C 1/101* (2013.01); *B66C 15/065* (2013.01); *B66C 13/18* (2013.01)
USPC ..... 212/276; 212/242; 212/259; 212/326; 212/327; 294/67.5

(58) Field of Classification Search
CPC ..... B66C 1/101; B66C 1/102; B66C 1/104; B66C 19/002; B66C 19/007; B66C 13/46; B66C 15/06; B66C 15/065; B66C 1/223
USPC ..... 212/276, 281, 242, 243, 251, 259, 326, 212/327; 254/278, 280, 283, 286; 187/262, 187/414, 900, 279, 288, 300, 391, 393; 294/81.3, 81.4, 67.5; 340/685
See application file for complete search history.

(56) References Cited

U.S. PATENT DOCUMENTS

| | | | | |
|---|---|---|---|---|
| 3,042,227 | A | 7/1962 | Tantlinger | |
| 3,598,440 | A * | 8/1971 | Ramsden et al. | 294/81.3 |
| 3,944,272 | A | 3/1976 | Fathauer | |
| 2006/0043748 | A1 * | 3/2006 | Stinis et al. | 294/81.51 |

FOREIGN PATENT DOCUMENTS

| | | |
|---|---|---|
| EP | 1 695 936 | 8/2006 |

* cited by examiner

*Primary Examiner* — Sang Kim
*Assistant Examiner* — Juan Campos, Jr.
(74) *Attorney, Agent, or Firm* — Gordon Rees Scully Mansukhani LLP

(57) ABSTRACT

A method for controlling a hoisting or lowering movement of a load, which is suspended from a hoisting mechanism of a crane by means of at least two hoisting cables trained round cable sheaves on the load, by monitoring the position of the load and braking and/or stopping the hoisting mechanism upon detection of an undesirable position, wherein the cable sheaves are each connected to the load for pivoting about a horizontal axis, and the position of the load is monitored by detecting a pivoting movement of at least one of the cable sheaves.

6 Claims, 3 Drawing Sheets

Figures 1, 1A:
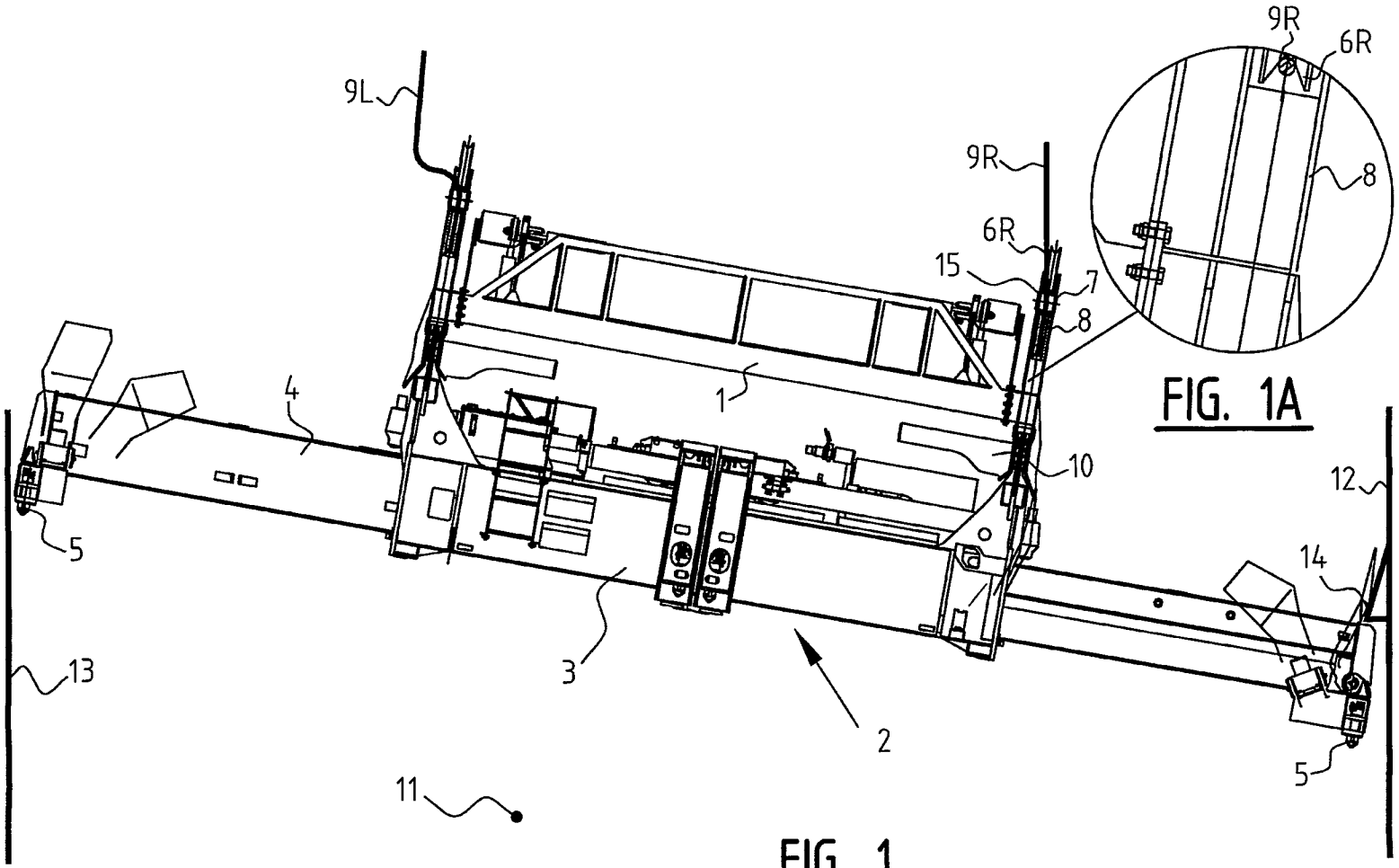

101
102
103
104
105
106L
106R
107
108
109L
109R
110
112
113
114
115
116
117
118
119
120
121
122
123
124

METHOD FOR CONTROLLING A HOISTING OR PAYING OUT MOVEMENT AND HOISTING FRAME HAVING TILTABLE CABLE SHREAVE FOR USE THEREIN

The invention relates to a method for controlling a hoisting or lowering movement of a load, which is suspended from a hoisting mechanism of a crane by means of at least two hoisting cables trained round cable sheaves on the load, comprising of monitoring the position of the load and braking and/or stopping the hoisting mechanism upon detection of an undesirable position. Such a method is known.

When hoisting or lowering a load by means of a crane, for instance during unloading or loading of a ship using a container crane on a quay, it is of great importance to detect and respond to undesirable, possibly dangerous movements of the load in good time. Such dangerous movements can hereby be prevented, for instance by braking or even completely halting the hoisting or lowering movement, and the consequences thereof, particularly possible damage, can be limited as far as possible.

A "load" is here understood to mean the weight below the hoisting cables of the crane. The load may therefore be only a so-called "head block" without any spreader(s) and/or container(s), although the load may also be formed by random combinations of a head block with spreader(s) and/or container(s).

In this respect "dangerous movements" are particularly understood to mean tilting movements. Different cases can be distinguished here. The load may thus tilt during hoisting or lowering and thereby become jammed in a cell of a ship. This is referred to as "snagging". The tilting movement can also be the result of contact of the load during hoisting or lowering thereof. Finally, the load may tilt when it is not set down in correct manner on a surface.

The present particularly has for its object to prevent or at least minimize the first stated movement, so-called snagging. During hoisting the load can make contact on one side in a cell of a ship due to an external influence, for instance an incorrect movement. The load will then usually tilt in longitudinal direction. Due to this tilting the load can become jammed and be damaged. In addition, the cable sheaves, the hoisting cables and/or the crane construction as a whole can also be damaged.

It must be borne in mind that fixed cable sheaves are usually applied in quayside cranes for container transfer. If the load tilts, the cable comes to lie at an angle relative to the sheave. When the angle becomes too great, the cable may be damaged and even break at the point where the cable comes into contact with the sheave. The sheave can also be damaged. The quicker the hoisting or lowering movement can be stopped, the less the resulting damage will be.

If damage has occurred, especially a damaged cable, the crane can then no longer function. Particularly if the crane is a centre crane of a number of mutually adjacently cranes on a ship, and when the quay provides little freedom of movement for another mooring position of the ship on the quay, this results in a serious fall in the transfer capacity.

The fall in the transfer capacity of the cranes results in the ship having to be docked longer than desired, which entails considerable cost. In addition, the breakdown of a crane as a result of damage also involves high costs in addition to the actual costs of repairing the crane, for instance replacing the hoisting cables. Finally, damage to the load can also entail considerable costs.

Methods known heretofore for controlling and keeping within acceptable limits the load on the hoisting cables are to measure the load in the hoisting cables, to apply so-called snag cylinders in the hoisting cable(s) themselves and/or to use levelling instruments.

In the first stated method, measuring the load in the hoisting cables, the crane will continue hoisting or lowering until a set maximum hoisting load is reached for the load to be hoisted. Only then does the crane respond by stopping the hoisting or lowering movement. If the speed is low, the crane then stops quickly and there will be hardly any chance of damage. If on the other hand the speed is high, for instance when hoisting an empty container, the braking distance required for stopping is much greater and both crane and load may be damaged.

Another solution used heretofore is to incorporate so-called snag cylinders in the hoisting cables. These snag cylinders serve in theory to limit the maximum force in the hoisting cables, whereby the load on the crane is also limited to a determined maximum. These snag cylinders have the drawback however that they respond very slowly. Testing of the operation of snag cylinders is further so dangerous to the crane and the surrounding area that it is usually not carried out. The correct functioning of these snag cylinders is therefore often theoretical.

Yet another solution which has been attempted relates to the use of electronic levellers (inclinometers) for the purpose of measuring the inclination of a load. Such levelling instruments are however also slow, and therefore not suitable for generating a timely signal with which tilting of the load can be prevented.

The present invention has for its object to develop the known method such that possible damage can be reduced considerably by more rapidly predicting an imminent malfunction. The quicker the crane is alerted to a dangerous situation, the quicker the crane can discontinue the hoisting or lowering movement, and the less damage occurs.

The method according to the invention is characterized for this purpose in that the cable sheaves are each connected to the load for pivoting about a horizontal axis, and the position of the load is monitored by detecting a pivoting movement of at least one of the cable sheaves. By allowing the sheaves to pivot or tilt the cable will no longer come into contact with the sheave at a dangerous angle (within the permissible tilt angle of the tilting sheave). Cable and sheave are thus much less likely to be damaged by this tilting.

Because such a pivoting or tilting movement will occur immediately the load is in danger of becoming jammed and begins to tilt, the crane can moreover respond very quickly. By measuring the tilting of one or more sheaves, the crane can in fact begin to function in accordance with this movement. The crane can hereby stop the hoisting or lowering movement much more quickly than is possible with the indicators currently in general use, such as detecting when the maximum hoisting load of the relevant hoist has been reached or the use of a slowly responding levelling instrument in order to measure the inclination of the load.

The invention further relates to a hoisting frame suitable for performing this method. A conventional hoisting frame, also referred to as head block, comprises at least two mutually parallel cable sheaves, each placed close to one of the mutually opposite ends of the frame and rotatable about a horizontal axis, for connecting the hoisting frame to hoisting cables of a crane.

According to a first aspect of the invention, a hoisting frame of this type is provided which is distinguished from the known frame in that each cable sheave is mounted on the frame for pivoting about a horizontal axis running perpendicularly of its rotation axis, and means are present for detecting a pivoting movement of each cable sheave about its axis.

The detection means can be adapted to generate a warning signal when the detected pivoting movement exceeds a determined limit value. A crane machinist can brake and/or stop the hoisting or lowering movement on the basis of this warning signal, which can for instance be optical or auditive.

In addition or instead, the detection means can be connected for signal generation to a control system of the crane. The crane can then respond in fully automatic manner to an imminent undesired movement or position of the hoisting frame.

A structurally simple, robust and reliable embodiment is obtained when the detection means for each cable sheave comprise at least one sensor arranged in the vicinity of the sheave on a part of the frame.

According to a second aspect of the invention, a hoisting frame of the known type is modified such that each cable sheave is mounted on the frame for pivoting about a horizontal axis running perpendicularly of its rotation axis, and means are present for biasing each cable sheave to a vertical position. These biasing means prevent the sheaves tilt sideways when the cables and sheaves are unloaded (for instance when the load is being placed). Tilting of the sheave in unloaded situation could result in a cell in damage to the immediate surrounding area. The biasing means must be adapted such that in the unloaded situation the sheave does not pivot due to swinging movements of the hoisting cable, but that the sheave does pivot during tilting of the load during the hoisting and lowering movement.

A structurally simple and robust embodiment is obtained here when the biasing means for each cable sheave comprise at least one spring arranged between the sheave and a part of the frame.

Finally, the invention also relates to a crane with which the above described method can be performed. Such a crane conventionally comprises an upright frame, at least one arm connected to the upright frame close to the top side, and a hoisting mechanism which comprises at least two hoisting cables which extend downward from the arm and which can be hauled in and payed out by means of a drive, which hoisting cables according to the invention are trained round the cable sheaves of a hoisting frame as described above.

The crane can be further provided with a system for controlling the hoisting mechanism, which control system is connected for signal receiving to the detection means of the hoisting frame. The control system is preferably adapted here to brake and/or to stop the hoisting mechanism when the detection means indicate that at least one of the cable sheaves of the hoisting frame performs a pivoting movement.

Figures 2, 2A:
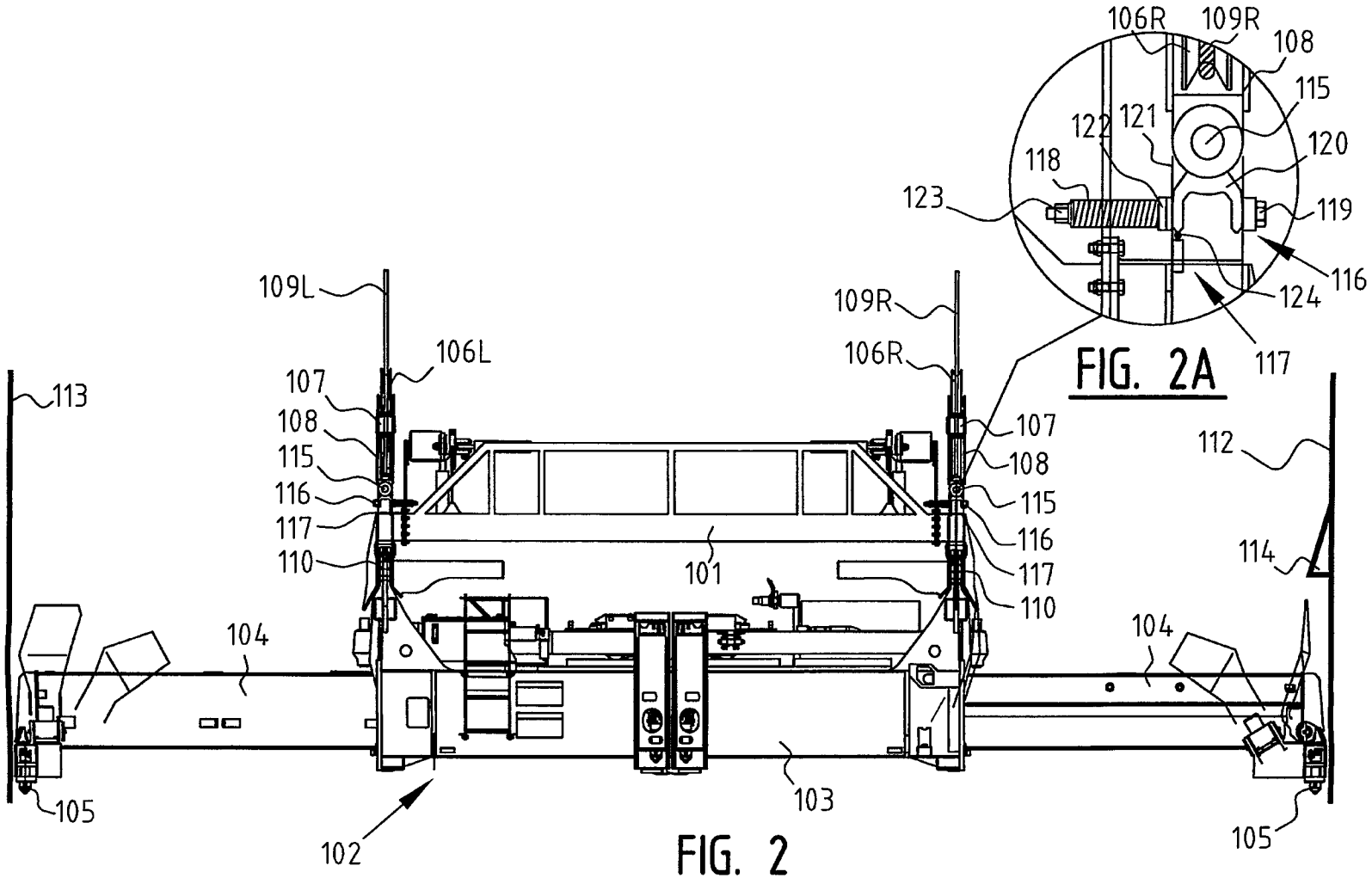
Figures 3, 3A:
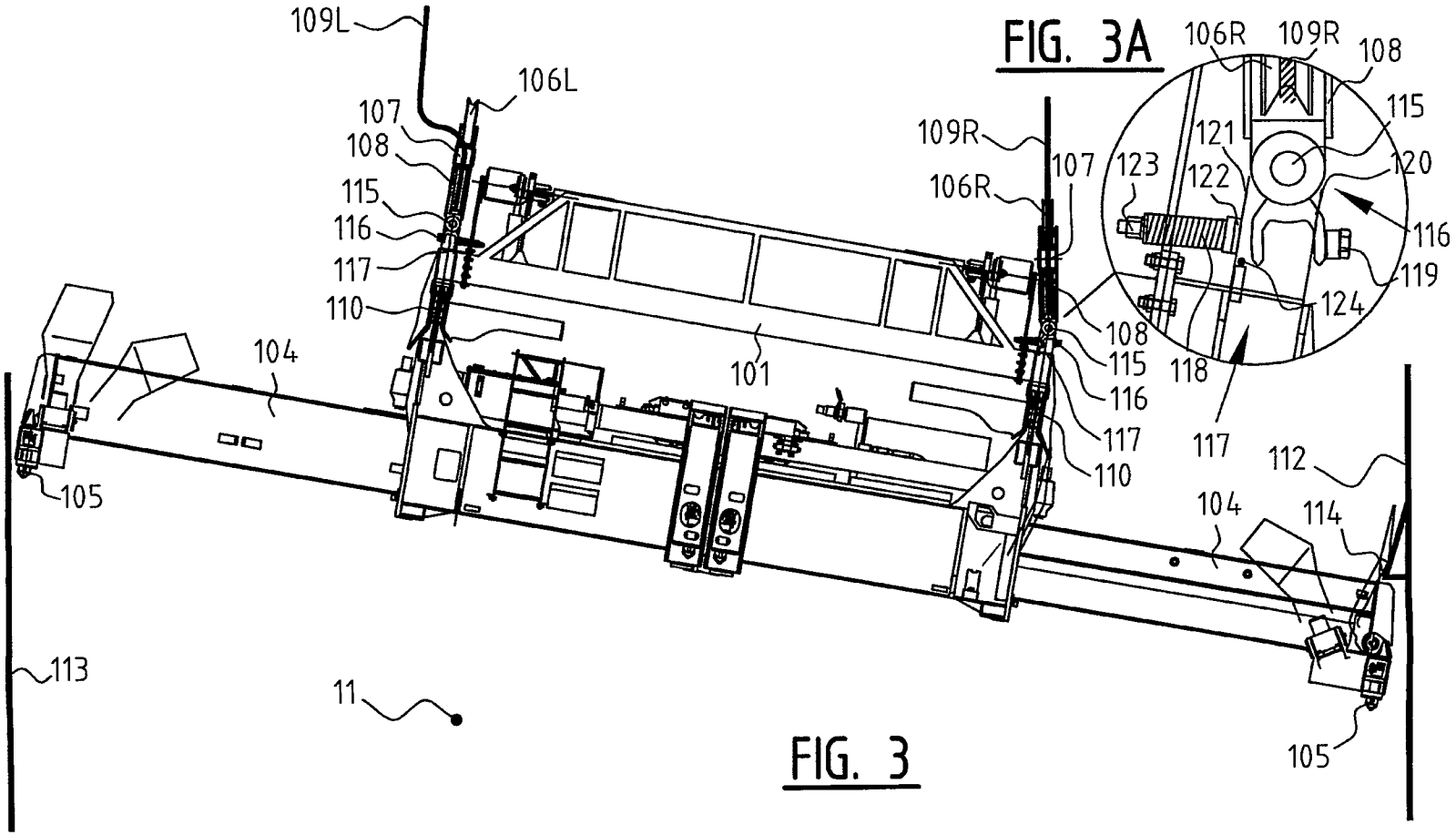

The invention is now elucidated on the basis of an example, wherein reference is made to the accompanying drawing, in which corresponding components are designated with reference numerals increased by 100, and in which:

FIG. 1 is a schematic side view of a conventional hoisting frame (head block) with a spreader suspended therefrom which becomes jammed in a cell, FIG. 1A is a detail view according to arrow A in FIG. 1, which shows the fixed connection of the housing of the cable sheave to the hoisting frame, FIG. 2 is a schematic side view of the hoisting frame according to the invention and a spreader suspended therefrom in horizontal position, just before reaching an obstacle in the cell, FIG. 2A is a detail view according to arrow A in FIG. 2, which shows the pivotal mounting of the housing of the cable sheave on the hoisting frame in the vertical rest position, FIG. 3 is a view corresponding with FIG. 1 of the hoisting frame according to FIG. 2, and FIG. 3A is a detail view according to arrow A in FIG. 3, which shows the pivotal mounting of the housing of the cable sheave on the hoisting frame in the pivoted or tilted position.

FIG. 1 shows a conventional hoisting frame 1 or head block, from which a spreader 2 is suspended by means of coupling elements, in the shown example pins 10. The spreader 2 shown here is length-adjustable and comprises a central body 3 in which arms 4 are received slidably on either side. At the end of each slidable arm 4 are arranged two so-called twist locks 5 which can engage in corner castings of a container (not shown here).

Hoisting frame 1 is provided close to both its outer ends with two cable sheaves 6L, 6R, each rotatable about a horizontal axis 7. Each cable sheave 6L, 6R is mounted in a housing or sheave casing 8, which is mounted on hoisting frame 1 as shown in FIG. 1A. Trained round each cable sheave 6L, 6R is a hoisting cable 9L, 9R, with which hoisting frame 1 is suspended from a crane (not shown).

Using this crane the hoisting frame 1 having spreader 2 and optionally one or more containers thereon can be lowered into a cell 11 of a ship and hoisted therefrom again. Cell 11 is herein provided with cell guides 12, 13 on either side. In the shown example an obstacle 14 is situated in cell 11 at the position of the right-hand cell guide. The right-hand side of spreader 2 hereby cannot move any further upward, so that the load starts to hang askew and possibly becomes completely jammed.

As a result the right-hand hoisting cable 9R is very heavily loaded, while the left-hand hoisting cable 9L slackens. The right-hand hoisting cable 9R here leaves sheave 6R at an angle and bends locally, this entailing the risk of breakage. Sheave 6R can also be damaged, while the associated sheave casing 8 is additionally loaded and hoisting frame 1 is exposed to a great bending moment. Finally, spreader 2 is very heavily loaded on the right-hand side, with a chance of damage.

These consequences are exacerbated in that the inclination is not measured, so that no active control of the crane is possible from hoisting frame 1. The hoisting gear of the crane will hereby only be stopped when the crane machinist sees what is happening. And if the load does actually become completely jammed in the cell, it can only be released using special additional cranes. The damage is then enormous.

FIG. 2 shows hoisting frame 101 according to the invention, which is provided with cable sheaves 106L, 106R which are each pivotable about a horizontal axis 115 lying perpendicularly of their respective rotation axis 107. Means 116 are present for biasing the two cable sheaves 106L, 106R to a vertical position. In the shown example these biasing means 116 comprise a set of springs 118 arranged between each sheave 106L, 106R and a part of hoisting frame 101. In particular, each spring 118 is arranged around a pin 119 which protrudes through a yoke 120 connected to sheave casing 108 and an upright wall part 121 of hoisting frame 101 (FIG. 2A). Spring 118 is enclosed between a ring 122 resting against wall part 121 and a nut 123 mounted on the end of pin 119. When sheave casing 108 performs a pivoting movement about axis 115 relative to hoisting frame 101, spring 118 will be compressed (FIG. 3A) or, conversely, extended, and herein exert a resetting force on sheave casing 108. These biasing means 116 or springs 118 thus prevent cable sheaves 106L, 106R beginning to move in the unloaded situation due to the swinging of hoisting cables 109L, 109R.

Means 117 are also present for detecting a pivoting movement of each cable sheave 106L, 106R about its axis 115.

These detection means 117 comprise for each cable sheave 106L, 106R a sensor or switch 124 which is arranged in the vicinity thereof on a part of hoisting frame 101. In the shown example sensor 124 is attached to upright wall part 121 and co-acts with yoke 120 on the underside of the pivotable sheave casing 108. This sensor 124 generates a warning signal when yoke 120 moves too far away and the detected pivoting movement of cable sheave 106L, 106R thus exceeds a determined limit value. Sensor 124 is moreover connected for signal generation to a control system of the crane so that the crane machinist can immediately see when hoisting frame 101 starts to incline.

FIG. 3 shows hoisting frame 101 according to the invention in the same situation as the conventional hoisting frame 1 in FIG. 1. Here also the load has become jammed on the right-hand side against obstacle 14 in the cell during hoisting. The load here also starts to hang askew and will possibly become completely jammed. As a result of the more structural modification of the hoisting frame according to the invention, the consequences are however considerably less serious.

As a result of the pivotable suspension of cable sheaves 106L, 106R the position of right-hand cable sheave 106R can be adjusted to the movement. The right-hand hoisting cable 109R hereby does not leave sheave 106R at an angle, and so will not bend locally either, so that there is little chance of breakage. Nor will cable sheave 106R itself be damaged.

In addition, the hoisting gear of the crane will be stopped more quickly because sensor 124 immediately signals the tilting of hoisting frame 101. The right-hand hoisting cable 109R is hereby loaded less heavily than in a hoisting frame with rigidly suspended cable sheaves 6L, 6R. The load on sheave casing 108 is also small, as is the bending moment in hoisting frame 101.

Finally, the load on the right-hand side of spreader 102 is also considerably lighter than in the case of a spreader with rigidly mounted cable sheaves 6L, 6R.

Although the invention is elucidated above on the basis of one embodiment, it will be apparent that this can be varied in many ways. It is thus possible to envisage other ways of connecting the cable sheaves movably to the hoisting frame. The biasing means and the detection means can also be embodied very differently without departing from the scope of the appended claims.

The invention claimed is:

1. A method for controlling a hoisting or lowering movement of a load, which is suspended from a hoisting mechanism of a crane by means of at least two hoisting cables trained round rotatable cable sheaves on the load, wherein each cable sheave rotates around a horizontal rotation axis, comprising of monitoring the position of a load and braking and/or stopping the hoisting mechanism upon detection of an undesirable position, wherein the cable sheaves are each connected to the load for pivoting about a horizontal pivot axis that is perpendicular to the horizontal rotation axis of the cable sheave, and a position of the load is monitored by detecting an individual pivoting movement of at least one of the cable sheaves about the pivot axis that is perpendicular to the horizontal rotation axis.

2. A hoisting frame, comprising at least two mutually parallel cable sheaves, wherein each cable sheave rotates around a horizontal rotation axis, each placed close to one of two mutually opposite ends of the frame, for connecting the hoisting frame to hoisting cables of a crane, wherein each cable sheave is mounted on the frame for pivoting about a horizontal pivot axis running perpendicularly to the horizontal rotation axis of the cable sheave, and means are present for detecting an individual pivoting movement of each cable sheave about the horizontal pivot axis running perpendicularly to the horizontal rotation axis of the cable sheave.

3. The hoisting frame of claim 2, wherein the detection means are adapted to generate a warning signal when the detected pivoting movement exceeds a determined limit value.

4. The hoisting frame of claim 2, wherein the detection means for each cable sheave comprise at least one sensor arranged in the vicinity of the sheave on a part of the frame.

5. A hoisting frame, comprising a main frame part extending generally in a horizontal direction and at least two mutually parallel cable sheaves, wherein each cable sheave rotates around a horizontal rotation axis, each cable sheave is placed close to one of two mutually opposite ends of the frame, for connecting the hoisting frame to hoisting cables of a crane, wherein each cable sheave is mounted on the frame for pivoting about a horizontal pivot axis running perpendicularly to the horizontal rotation axis of the cable sheave, and means are present for biasing each cable sheave casing to a position perpendicular to the main frame part of the hoisting frame, said biasing means acting in a direction substantially parallel to the horizontal rotation axis of the cable sheave.

6. The hoisting frame of claim 5, wherein the biasing means for each cable sheave comprise at least one spring arranged between the sheave and a part of the frame.

* * * * *